United States Patent [19]

Okajima et al.

[11] Patent Number: 4,681,623

[45] Date of Patent: Jul. 21, 1987

[54] PROCESS FOR PRODUCING ALLOY POWDER CONTAINING RARE EARTH METALS

[75] Inventors: Yasuhiro Okajima; Yasuhiro Tsugita, both of Niihama; Tamaki Takechi, Saijyo; Syuji Okada, Mitoyo, all of Japan

[73] Assignee: Sumitomo Metal Mining Company Limited, Tokyo, Japan

[21] Appl. No.: 877,128

[22] Filed: Jun. 23, 1986

[30] Foreign Application Priority Data

Jun. 24, 1985 [JP] Japan ..... 60-137512

[51] Int. Cl.[4] ..... B22F 9/00

[52] U.S. Cl. ..... 75/0.5 B; 75/0.5 BB

[58] Field of Search ..... 75/0.5 B, 0.5 BA, 0.5 BB

[56] References Cited

U.S. PATENT DOCUMENTS 3,623,861 11/1971 Arias ..... 75/0.5 B 3,690,963 9/1972 Spink ..... 75/0.5 B

*Primary Examiner*—Peter D. Rosenberg

*Attorney, Agent, or Firm*—Watson, Cole, Grindle & Watson

[57] ABSTRACT

An alloy metal powder which contains rare earth metals and which has a uniform composition and contains a minimum of residual reducing agent and oxygen is produced by (1) preparing a mixture composed of (a) a powder of rare earth metal oxide, (b) a powder of a metal which is difficult to volatize at 900° to 1300° C., (c) at least one reducing agent selected from alkali metals, alkaline earth metals, and hydrides thereof, and (d) at least one chloride selected from alkali metal chlorides and alkaline earth metal chlorides, (2) heating the mixture in an inert gas atmosphere or under vacuum to provide a reaction mixture, and (3) treating the reaction mixture by a wet process.

13 Claims, No Drawings

PROCESS FOR PRODUCING ALLOY POWDER CONTAINING RARE EARTH METALS

BACKGROUND OF THE INVENTION

1. Field of the Invention

The present invention relates to a process for producing an alloy powder containing rare earth metals. More particularly, it relates to a process for economically producing an alloy powder containing rare earth metals with a low content of oxygen and residual reducing agent.

2. Description of the Prior Art

It is known that alloys (including intermetallic compounds) composed of rare earth metals as a main component are useful for a permanent magnet material, magnetostrictive material, magnetic sensor, magnetic refrigerator, optomagnetic recording material, hydrogen occlusion material, etc.

According to a well-known process, the alloys containing rare earth metals are produced by the steps of preparing respective ingots of rare earth metals and alloying elements (or preparing mother alloys) and melting them using a high-frequency melting furnace.

Where the alloy thus obtained is to be made into a permanent magnet, it is necessary to crush the alloy into fine powder, which subsequently undergoes pressing and sintering. Making a powder by crushing an alloy is disadvantageous because this crushing process is required and rare earth metals are easily oxidized during crushing, adversely affecting the quality of the alloy.

In order to eliminate this disadvantage, there was proposed the so-called reducing diffusion process for the production of alloy powder. This process is now in practical use. According to this process, a rare earth metal-cobalt magnet powder is produced in the following manner. A powder of rare earth metal oxide and a powder of metallic cobalt are mixed with metallic calcium or calcium hydride as a reducing agent. The mixture is heated in an inert gas atmosphere or vacuum, so that the rare earth metal oxide is brought into contact with the melt or vapor of metallic calcium for reduction. Concomitant with reduction, the rare earth metal formed by reduction diffuses into the cobalt particles. Thus there is obtained an alloy powder of uniform composition. The reaction product thus obtained is a mixture of CaO formed as a by-product, unreacted excess metallic calcium, and the desired alloy powder. These components are present in the form of sintered complex mass. When the mass is thrown into water, CaO and metallic calcium changes into $Ca(OH)_2$. Thus alloy powder can be easily separated from $Ca(OH)_2$ which suspend in the water. Residual $Ca(OH)_2$ is removed by washing the alloy metal with acetic acid or hydrochloric acid.

When thrown into water, the mixture mass disintegrates into fine powders on account of the oxidation of metallic calcium by water and the hydration of CaO. This method is economically advantageous because the raw material of rare earth metal is a comparatively cheap oxide, the melting and casting steps are not required, and the crushing step is not required (at least primary crushing is not required). In addition, this method can be applied to not only the production of cobalt alloy powders but also the production of powders of ferro-alloy, nickel alloy, or copper alloy containing a rare earth metal.

The present inventors carried out a series of researches on the application of the above-mentioned reducing diffusion method to the production of a variety of alloy powders containing rare earth metals. As the result, it was found that this method does not provide alloy powders which are satisfactory in particle size and quality for the reasons given below. According to the reducing diffusion method, a mixture composed of particles of rare earth metal oxide, particles of alloying metals, and granules of reducing agent such as metallic calcium is heated in argon or vacuo at 900° to 1300° C. The reaction of a rare earth metal oxide with a reducing agent starts at about 700° C., and the temperature of the reaction product exceeds 1300° C. in a short time because of the exothermic reaction. (The maximum temperature varies depending on the type and amount of rare earth metal oxide used.) This high temperature evaporates the reducing agent having a high vapor pressure, causing the reduction reaction to terminate in a comparatively short time (5 to 12 minutes). On the other hand, continued heating for 1 to 6 hours at 900° to 1300° C. is required for diffusion to provide an alloy of uniform composition. The exothermic reaction and heating at a high temperature coarsen the resulting alloy powder. (The average particle diameter of the resulting alloy powder is greater than twice that of metal powder used as a raw material.) For the production of a powder of uniform composition, it is necessary to perform diffusion sufficiently by raising the heating temperature or extending the heating time, or using a finer metal powder as a raw material.

Diffusion in such a manner, however, results in coarse particles through the binding or metal particles and alloy particles together, and promotes the binding of particles with the oxide of the reducing agent. The resulting mixture mass does not readily disintegrate when thrown into water, and this leads to poor separation of alloy particles from the oxide of the reducing agent. Due to the reasons mentioned above, a finely divided powder of uniform composition is not obtained simply by using a finer metallic powder as a raw material.

The ability of the mixture mass to disintegrate in water is considerably reduced when the content of rare earth metal in the alloy is high or when the metal powder as a raw material is iron or ferroalloy. The reason for this is considered as follows: Concomitant with an increase in the ratio of rare earth metal oxide, it is necessary to increase the amount of the reducing agent. This, in turn, generates more heat and forms more oxides of the reducing agent. In addition, iron powder (or ferroalloy powder) tends to firmly sinter.

The disintegrability in water may be improved to some extent by increasing the amount of reducing agent. Usually the amount of reducing agent added in the reducing diffusion method is 1.1 to 1.5 times the stoichiometric amount necessary for the reduction of rare earth metal oxide. For the improvement of disintegrability, it is necessary to add more than twice the stoichiometric amount. However, increasing the amount of reducing agent is not a drastic solution to disintegrability; rather it leads to an increase in by-product and concomitant loss of alloy powder and also to a cost increase.

In the case where the reaction product does not readily disintegrate, one of the countermeausres is to repeat stirring and decantation and/or to carry out milling or wet milling after the reaction product has been thrown into water. These means are effective in reducing to some extent the amount of residual reducing agent in the resulting powder; however, on the other hand, it produces an adverse effect of increasing the oxygen content due to oxidation reaction and decreasing the yield due to an increased dissolution loss in the subsequent acid treatment. Additional adverse effects are that it is necessary to lower the pH for acid treatment, to increase the number of acid treatment cycles, and to extend the time of acid treatment. The acid treatment under such conditions increases the dissolution of the alloy components. In the case of ferroalloys, the dissolution of Fe leads to a decrease of yield and the dissolved Fe oxides and hydrolyzes to increase the oxygen content in the resulting product.

As mentioned above, the reducing diffusion method for the production of alloys containing a rare earth metal has technical and economical problems. These problems are serious particularly in the cases where the alloy powder contains rare earth metals in a high ratio, the alloy powder contains light rare earth metals (lanthanum, cerium, praseodymium, and neodymium) which are readily oxidized the alloy powder contains Fe as an alloy component, and the alloy powder has a small average particle diameter less than 15 μm. Under these circumstance, there has been a demand for a new process for producing an alloy powder containing a rare earth metal of different kind which meets the requirements for composition, quality and shape.

SUMMARY OF THE INVENTION

Accordingly, it is an object of the present invention to provide a process for producing a finely divided alloy powder containing rare earth metals, the powder having a uniform composition and containing a minimum amount of residual reducing agent and oxygen.

The gist of this invention resides in an improved process for producing an alloy powder containing rare earth metals by heating in an inert gas atmosphere or under vacuum a mixture composed of a powder of rare earth metal oxide, a powder of a metal which is difficult to volatize at 900° to 1300° C., and at least one reducing agent selected from alkali metals, alkaline earth metals, and hydrides thereof, and treating the reaction mixture by wet process, characterized in that the mixture for heating contains at least one member selected from alkali metal chlorides and alkaline earth metal chlorides.

DETAILED DESCRIPTION OF THE INVENTION

The rare earth metals in this invention include lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), lutetium (Lu), promethium (Pm), yttrium (Y), and scandium (Sc).

The rare earth metal oxide used in the process of this invention may be an oxide of any of the above-mentioned rare earth metals. Two or more oxides may be used in combination with one another.

The powder of a metal which is difficult to volatize at 900° to 1300° C. is composed of an alloy element which, in combination with the above-mentioned rare earth metal, forms the desired alloy. One or more metal powders may be used according to the composition of the desired alloy. Examples of this metal include cobalt (Co), iron (Fe), nickel (Ni), manganese (Mn), copper (Cu), silicon (Si), aluminum (Al), molybdenum (Mo), chromium (Cr), boron (B), zirconium (Zr), hafnium (Hf), niobium (Nb), tantalum (Ta), titanium (Ti), magnesium (Mg), vanadium (V), and tungsten (W). The metal powder may be a powder of an alloy containing two or more kinds of these metals.

In the case where the alloy powder obtained by the process of this invention is used as a permanent magnet material, magnetostrictive material, magnetic sensor, magnetic refrigerator, optomagnetic recording material, hydrogen occlusion material, etc., any of the above-mentioned metals from Co to Cr is used as the principal alloy element and any of the above-mentioned metals from B to W is used as the secondary alloy element. These alloy elements (excluding the rare earth metals) are used in the form of metallic powder in most cases; however, a portion of them may be in the form of oxide or chloride. Where the amount of the alloy elements is small, all of them may be used in the form of oxide or chloride.

The powder of the rare earth metal oxides is not specifically limited in particle size; however, it should preferably have an average particle diameter in the range of 1 to 50 μm (measured by the Fisher Subsieve Sizer (Fsss) method). With an average particle diameter greater than 50 μm, the powder of the rare earth metal oxide does not mix well with the metallic powder, with the result that the alloy powder is not uniform in composition. The powder finer than 1 μm is not readily available.

The powder of the metal which is difficult to volatize should preferably have a particle size smaller than 100 mesh (Tyler, the same shall apply hereinafter). For the production of fine alloy powder, it is preferable to use a powder having an average particle size smaller than half the intended average particle size. According to the process of this invention, it is possible to use a metal powder having a comparatively great particle size because the resulting mixture is readily disintegrable even after heating for a long time. Extended heating permits complete diffusion and makes the particle composition uniform.

The reducing agent used in this invention is an alkali metal, an alkaline earth metal, or an hydride thereof. Examples of the reducing agent include lithium, sodium, potassium, and magnesium, and hydrides thereof. Calcium is preferable from the standpoint of handling safety and cost. These metals and metal hydrides are used in the form of granule or powder. Granular metallic calcium having a grain size of 4 mesh or less is preferable from the standpoint of cost. The reducing agent should be used in an amount of 1.1 to 2.0 times the stoichiometric amount necessary to reduce the rare earth metal oxide.

The alkali metal chloride and alkaline earth metal chloride used in this invention include chlorides of lithium, sodium, potassium, and magnesium. Anhydrous chlorides are preferable. Anhydrous calcium chloride is particularly preferable because of its low cost and nonvolatility. The alkali metal chloride and alkaline earth metal chloride should be used in an amount of 1 wt % or above based on the amount of the rare earth metal oxide. With an amount less than 1 wt %, the resulting mixture does not readily disintegrate in water. For the production of a finely divided alloy powder, the amount should preferably be 3 to 20 wt %.

According to the process of this invention, a mixture of the abovementioned powders is heated in an inert gas atmosphere or under vacuum. Examples of the inert gas include argon and nitrogen. The heating temperature should be 900° to 1300° C., preferably 950° to 1100° C. The heating time is not specifically limited, but the heating time should be long enough to bring about diffusion for uniform composition.

The process of this invention is now described in more detail with reference to an example in which metallic calcium is used as a reducing agent and anhydrous calcium chloride is used as a chloride. At first, a powder of one or more kinds of rare earth metal oxide and a powder of one or more kinds of metal or alloy which constitutes the difficult to volatize alloy component are mixed with anhydrous calcium chloride powder and metallic calcium granules (as a reducing agent). The amount of each component depends on the composition of the desired product. Usually the first three components are thoroughly mixed and then the fourth component is added. The mixing should be performed in an inert gas atmosphere to prevent moisture absorption. The mixture should be heated in a reactor filled with an inert gas such as argon.

As the mixture is heated, heat generation takes place at 700° to 800° C. due to the reduction of the rare earth metal oxide with metallic calcium. In the process of this invention, the peak temperature of heat generation is much lower than that in the conventional process or it does not exist in some cases. This is a feature of this invention. Presumably, the absence of peak temperature is attributable to the calcium chloride (m.p. 772° C.) which absorbs heat generated by reduction. Thus calcium chloride prevents the excessive temperature rise that would otherwise cause the melting and adhesion of raw material metallic powder, resulting alloy powder, and calcium oxide formed as a by-product. The reaction mixture in the reactor should be kept at 900° to 1300° C. The maximum temperature and heating time should be determined in consideration of the particle size of the metal or alloy charged and intended particle size and uniform composition of the desired alloy. For the production of finely divided alloy powder of uniform composition, the heating temperature should be 950° to 1100° C. and the heating time should be 1 to 5 hours, preferably 1 to 3 hours.

After heating, the resulting mixture should be cooled in an inert gas atmosphere. This reaction mixture is a porous complex substance in which the particles of the resulting alloy are surrounded by calcium oxide containing calcium chloride. The residual calcium in the complex substance is partly dissolved in calcium chloride. When the reaction mixture is thrown into water, the residual metallic calcium reacts with water to generate hydrogen and calcium chloride dissolves in water, with the result that the reaction mixture disintegrates very rapidly. After disintegration, the alloy particles are completely separate from $Ca(OH)_2$ and the alloy particles are free of any calcium compounds. In order for the resulting mixture to be readily disintegrable, the amount of calcium chloride should be 1 wt % or above for the rare earth metal oxide. However, for the production of finely divided alloy powder, the amount of calcium chloride should be 3 to 20 wt %.

The reaction mixture obtained in the process of this invention readily disintegrates in a short time, forming a slurry, when thrown into water. After distintegration, the alloy particles are completely separate from the calcium compounds, and consequently no mechanical crushing is necessary. The upper layer of the slurry is a suspension of $Ca(OH)_2$, and it can be mostly removed from the alloy powder by repeating decantation. A small amount of residual $Ca(OH)_2$ and oxide film on the alloy powder may be effectively removed by washing with dilute acetic acid or hydrochloric acid of pH 4 to 7. The pH of the dilute acid varies depending on the composition of the alloy powder. For an alloy powder containing iron, the dilute acid should be adjusted to pH 5 to 7, preferably pH 5.5 to 6.5, because iron is readily soluble in acids.

After acid treatment, the alloy powder should be washed with an organic solvent such as alcohol and acetone for dehydration prior to drying. The organic solvent should be removed by vacuum drying.

The invention is now illustrated by the following examples, in which "%"means "wt %", "μm" representing the particle size is based on the Fsss method, and "mesh" is based on Tyler standard screen scale sieve.

EXAMPLE 1

The following three components were mixed in argon.

Praseodymium oxide powder ($Pr_6O_{11}$ purity 96.0%) having an average particle size of 10 μm:408 g;

Nickel powder (Ni purity 99.9%) having an average particle size of 5.4 μm:676 g;

Calcium granules (Ca purity 99%) having a particle size smaller than 4 mesh:251 g (The amount of calcium is 1.5 times the stoichiometric amount necessary for the reduction of praseodymium oxide.).

The resulting mixture was further mixed with 40 g of anhydrous calcium chloride. The mixture composed of the four components was placed in a stainless steel reactor and heated to 1000° C. over about 1 hour under an argon stream. The reactor was kept at 1000° C. for 2 hours. After cooling, the reaction mixture was discharged. 1350 g of the reaction mixture was thrown into 10 liters of water. It completely disintegrated to form a slurry within about 5 minutes with reactions involving gas generation. After settling of the slurry, $Ca(OH)_2$ suspending in the upper layer was removed by decantation. With water added, the slurry was stirred for 2 hours and the upper layer was discarded by decantation. This step was repeated twice.

The alloy powder slurry thus obtained had pH 10.5. The slurry was adjusted to pH 5.0 by adding dropwise dilute acetic acid. After keeping this pH value for 15 minutes, the alloy powder was filtered out, followed by washing several times with ethanol. The alloy powder was dried at 50° C. under a vacuum of $10^{-2}$ Torr for 12 hours. The dried alloy powder was found to have an average particle diameter of 10.1 μm and to contain 32.0% of Pr, 0.10% of Ca, and 0.12% of O. The individual particles were uniformly composed of Pr and Ni. The yield of Pr was 96.6% and the product yield (the ratio of Pr and Ni in the product to Pr and Ni charged) was 98.6%.

COMPARATIVE EXAMPLE 1

A raw material mixture was prepared in the same manner as in Example 1, except that the amount of calcium granules was changed to 218 g and anhydrous calcium chloride was not used. The mixture was heated under the same condition as in Example 1. The resulting reaction mixture (1310 g) was thrown into 10 liters of water. The reaction in water was so slow that complete disintegration did not take place even after 20 hours although a slurry was formed after stirring for 2 hours. Suspending $Ca(OH)_2$ in the slurry was separated by repeating decantation ten times. The resulting alloy powder slurry had pH 12.8.

The slurry was kept at pH 5.0 by adding dropwise dilute acetic acid and stirring for 30 minutes. The slurry was filtered and the particles were washed several times with ethanol, followed by drying at 50° C. under a vacuum of $10^{-2}$ Torr for 12 hours. The resulting alloy powder was found to contain 1.2% of calcium and 1.1% of oxygen. The alloy powder had such a particle size distribution that coarse particles over 100 mesh account for 57%. In other words, the alloy powder produced according to the conventional process contains calcium and oxygen at a high level and has a large grain size. In this comparative example, the yields of Pr and product were 93.0% and 96.5%, respectively.

EXAMPLE 2

The following five components were mixed in argon.

Neodymium oxide powder ($Nd_2O_3$ purity 99.9%) having an average particle size of 8 μm:405 g;

Electrolytic iron powder having an average particle size smaller than 325 mesh:608 g;

Ferro-boron (B content: 18.7%) having a particle size smaller than 200 mesh:65 g;

Calcium granules (Ca purity 99%):217 g (The amount of calcium is 1.5 times the stoichiometric amount necessary for the reduction of neodymium oxide.);

Anhydrous calcium chloride:20 g.

The resulting mixture was placed in a stainless steel reactor and heated to 1000° C. over about 1 hour under an argon stream. The reactor was kept at 1000° C. for 2 hours. After cooling, the reaction mixture was discharged and thrown into 10 liters of water. It completely disintegrated to form a slurry within 15 minutes. After the slurry had settled, $Ca(OH)_2$ suspending in the upper layer was removed by decantation. With water added, the slurry was stirred for 2 hours and the upper layer was discarded by decantation. This step was repeated three times.

The alloy powder slurry thus obtained had pH 9.8. The slurry was adjusted to pH 6.0 by adding dropwise dilute acetic acid. After keeping this pH value for 5 minutes, the alloy powder was filtered out, followed by washing several times with ethanol. The alloy powder was dried at 50° C. under a vacuum of $10^{-2}$ Torr for 12 hours. The dried alloy powder was found to have an average particle diameter of 20 μm and to have a uniform composition. Nd:33.5%, B:1.30%, Ca:0.02%, and O:0.15%. The yields of product and Nd were 96.5% and 95.0%, respectively. The phase of residual metallic Fe was not found in the alloy particle.

DCOMPARATIVE EXAMPLE 2

A raw material mixture was prepared in the same manner as in Example 2, except that the amount of calcium granules was changed to 434 g and anhydrous calcium chloride was not used. The mixture was heated under the same condition as in Example 2. After cooling, the reaction mixture was thrown into water. The reaction in water was so slow that almost no disintegration took place even after 24 hours.

COMPARATIVE EXAMPLE 3

A raw material mixture was prepared and heated in the same manner as in Comparative Example 2, except that the electrolytic iron powder was replaced by the one having a particle size of 100 to 325 mesh. The resulting reaction mixture was thrown into 20 liters of water. The reaction in water was so slow that grains of several millimeters in size remained undisintegrated even after 20 hours. After stirring for 2 hours, suspending $Ca(OH)_2$ in the slurry was separated by repeating decantation ten times. The resulting alloy powder slurry had pH 11.5.

The slurry was kept 15 pH 6.0 by adding dropwise dilute acetic acid and stirring for 20 minutes. The slurry was filtered and the particles were washed several times with ethanol, followed by drying at 50° C. under a vacuum of $10^{-2}$ Torr for 12 hours. The dried alloy powder was not uniform in composition. Nd:29.2%, B:1.30%, Ca:0.18%, and O : 0.63%. The yields of product, Nd, and Fe were 91.6%, 77.2%, and 81.0%, respectively. The phase of metallic Fe remained in the center of the particle. Thus the alloy powder was not suitable for the production of magnets.

EXAMPLE 3

The following six components were mixed in argon.

Neodymium oxide powder ($Nd_2O_3$ purity 99.9%) having an average particle size of 8 μm:408 g;

Boron oxide powder ($B_2O_3$ purity 98%) having an average particle size of 15 μm:75 g;

Cobalt powder (Co purity 99.5%) having a particle size smaller than 200 mesh:130 g;

Iron powder (Fe purity 99.5%) having a particle size smaller than 200 mesh:424 g;

Calcium granules (Ca purity 99%) having a particle size smaller than 4 mesh:219 g (The amount of calcium is 1.5 times the stoichiometric amount necessary for the reduction of neodymium oxide.);

Anhydrous calcium chloride:41 g.

The resulting mixture was placed in a stainless steel reactor and heated to 1000° C. over 80 minutes under an argon stream. The reactor was kept at 1000° C. for 3 hours. After cooling, the reaction mixture was discharged and thrown into 10 liters of water. It completely disintegrated to form a slurry within 15 minutes. After the slurry had settled, $Ca(OH)_2$ suspending in the upper layer was removed by decantation. With water added, the slurry was stirred for 2 hours and the upper layer was discarded by decantation. This step was repeated twice.

The alloy powder slurry thus obtained was adjusted to pH 6.0 by adding dropwise dilute acetic acid. After stirring at this pH value for 10 minutes, the alloy powder was filtered out, followed by washing with ethanol. The alloy powder was dried at 50° C. under a vacuum of $10^{-2}$ Torr for 6 hours. The dried alloy powder was found to contain no residual metallic Fe phase and Co phase. The alloy powder was composed of Nd 34.5%, Fe 49.4%, Co 13.7%, B 2.11%, Ca 0.02%, and O 0.15%. The yields of Nd, B, and product were 95%, 91%, and 96.7%, respectively.

COMPARATIVE EXAMPLE 4

A raw material mixture was prepared in the same manner as in Example 3, except that anhydrous calcium chloride was not used, and the resulting mixture was heated in the same manner as in Example 3 to give a reaction mixture. The reaction mixture did not disintegrate in water even after immersion for 24 hours.

EXAMPLE 4

The following six components were mixed in argon.

Neodymium oxide powder ($Nd_2O_3$ purity 99.9%) having an average particle size of 8 μm:418 g;

Dysprosium oxide powder ($Dy_2O_3$ purity 99.9%) having an average particle size of 10 μm:37 g;
Iron powder (Fe purity 99%) having a particle size smaller than 325 mesh:565 g;
Ferroboron powder (B content 18.7%) having a particle size smaller than 200 mesh:70 g;
Anhydrous calcium chloride:45 g;
Calcium granules (Ca purity 99%) having a particle size smaller than 4 mesh:195 g (The amount of calcium is 1.2 times the stoichiometric amount necessary for the reduction of neodymium oxide and dysprosium oxide.)

The resulting mixture was placed in a stainless steel reactor and heated to 1050° C. over 160 minutes under an argon stream. The reactor was kept at 1050° C. for 2 hours. After cooling, the reaction mixture was discharged and thrown into 5 liters of water. It completely disintegrated to form a slurry within 25 minutes. After the slurry had settled, $Ca(OH)_2$suspending in the upper layer was removed by decantation. With water added, the slurry was stirred for 30 minutes and the upper layer was discarded by decantation. This step was repeated three times.

The alloy powder slurry thus obtained was adjusted to pH 6.0 by adding dropwise dilute acetic acid. After stirring at this pH value for 10 minutes, the alloy powder was filtered out, followed by washing with ethanol. The alloy powder was dried at 40° C. under a vacuum of 0.1 Torr for 5 hours. The dried alloy powder was found to contain no residual metallic Fe phase. The alloy powder was composed of Nd 34.1%, Dy 2.9%, Fe 61.3%, B 1.31%, Ca 0.04%, and O 0.10%. The yields of Nd, Dy, and product were 94%, 94%, and 97.0%, respectively.

EXAMPLE 5

The following four components were mixed in argon.
Gadolinium oxide powder ($Gd_2O_3$ purity 99.9%) having an average particle size of 12 μm:565 g;
Cobalt powder (Co purity 99.5%) having a particle size distribution that particles smaller than 325 mesh account for 95%:510 g;
Calcium granules (Ca purity 99%) having a particle size smaller than 4 mesh:243 g (The amount of calcium is 1.3 times the stoichiometric amount necessary for the reduction of gadolinium oxide.);
Anhydrous calcium chloride:85 g.

The resulting mixture was placed in a stainless steel reactor and heated to 1050° C. over 80 minutes under an argon stream. The reactor was kept at 1050° C. for 2 hours. After cooling, the reaction mixture was discharged and thrown into 5 liters of water. It completely distintegrated to form a slurry within 20 minutes. After the slurry had settled, $Ca(OH)_2$ suspending in the upper layer was removed by decantation. With water added, the slurry was stirred for 2 hours and the upper layer was discarded by decantation. This step was repeated twice.

The alloy powder slurry thus obtained had pH 10.2. The slurry was adjusted to pH 5.0 by adding dropwise dilute acetic acid. After stirring at this pH value for 30 minutes, the alloy powder was filtered out, followed by washing with ethanol. The alloy power was dried at 50° C. under a vacuum of 0.2 Torr for 12 hours. The dried alloy powder was found to contain uniformly distributed Gd and Co. The alloy powder was composed of Gd 48.9%, Ca 0.03%, and O 0.10%. The yields of Gd and product were 98% and 98.5%, respectively.

EXAMPLE 6

The following five components were mixed in argon.
Terbium oxide powder ($Tb_4O_7$ purity 99.9%) having an average particle size of 12 μm:294 g;
Gadolinium oxide powder ($Gd_2O_3$ purity 99.8%) having an average particle size of 12 μm:288 g;
Ferro-cobalt powder (Co content 20.5% and Fe content 79.0%) having a particle size smaller than 200 mesh:500 g;
Calcium granules (Ca purity 99%) having a particle size smaller than 4 mesh:244 g (The amount of calcium is 1.3 times the stoichiometric amount necessary for the reduction of terbium oxide and gadolinium oxide.);
Anhydrous calcium chloride:58 g.

The resulting mixture was heated under the same conditions as in Example 4. The reaction mixture was thrown into water. It completely disintegrated to form a slurry within 20 minutes. After the slurry had settled, $Ca(OH)_2$ suspending in the upper layer was removed. With water added, the slurry was stirred for 1 hour and the upper layer was discarded by decantation. This step was repeated three times.

The alloy powder slurry thus obtained was adjusted to pH 5.0 by adding dropwise dilute acetic acid. After stirring at this pH value for 10 minutes, the alloy powder was filtered out, followed by washing with ethanol. The alloy powder was dried at 30° C. under a vacuum of 0.1 Torr for 6 hours. The dried alloy powder was found to contain uniformly distributed Gd, Tb, Fe, and Co. The alloy powder was composed of Tb 24.5%, Gd 24.8%, Co 10.1%, Fe 39.5%, Ca 0.04%, and O 0.10%. The yields of Tb, Gd, and product were 98%, 98%, and 98.5%, respectively.

Examples 5 and 6 demonstrate that the process of this invention is suitable for the production of an alloy powder containing rare earth metals at a high content.

EXAMPLE 7

The following four components were mixed in argon.
Samarium oxide powder ($Sm_2O_3$ purity 97 3%):371 g;
Cobalt powder having such a particle size distribution that particles smaller than 325 mesh account for 95% and the average particle size (Fsss) is 4.0 μm:669 g;
Calcium granules (Ca purity 99%) having a particle size smaller than 4 mesh:161 g (The amount of calcium is 1.3 times the stoichiometric amount necessary for the reduction of samarium oxide.);
Anhydrous calcium chloride:37 g.

The resulting mixture was heated under the same conditions as in Example 4. The reaction mixture was thrown into water. It completely disintegrated to form a slurry within 10 minutes. After the slurry had settled, $Ca(OH)_2$ suspending in the upper layer was removed. With water added, the slurry was stirred for 1 hour and the upper layer was discarded by decantation. This step was repeated three times.

The alloy powder slurry thus obtained was adjusted to pH 5.0 by adding dropwise dilute hydro-chloric acid. After stirring at this pH value for 20 minutes, the alloy powder was filtered out, followed by washing with ethanol. The alloy powder was dried at 50° C. under a vacuum of 0.1 Torr for 6 hours. The dried alloy powder was found to have an average particle diameter (Fsss) of 10.5 μm. Individual particles are composed of single phase of $SmCo_5$ in which Sm and Co are uniformly distributed. The alloy powder was contained Sm 33.2%, Ca 0.07%, and O 0.08%. The yields of Sm and product were 98.0% and 98.5%, respectively.

The alloy powder obtained in this example has a smaller average particle size than the conventional product, and it contains Ca and O in a less amount.

As mentioned above, according to the process of this invention, it is possible to produce an alloy powder of uniform composition containing rare earth metals in which the amounts of residual reducing agent and oxygen are small. The powders of raw material metal do not become coarse in the process and the reaction mixture resulting from heat treatment of raw materials readily disintegrates in water to form fine powders. Therefore, it is possible to produce easily an alloy powder of intended particle size. This effect is produced regardless of the type of the metal used as a raw material. Thus it is possible to produce a finely divided alloy powder if the raw materials are fine powders.

According to the process of this invention, finely divided alloy powders can be produced without mechanical crushing and the reducing agent can be removed in a short time by wet process. It is not necessary to use an excess amount of reducing agent. Therefore, the process is economically advantageous and suitable for mass production. The acid treatment in wet process is performed under a mild condition and the dissolution of alloy powder by acid is minimized. This leads to high yields of alloy powder.

What is claimed is:

1. In a process for producing an alloy powder containing rare earth metals which includes the steps of (a) preparing a mixture containing a powder of rare earth metal oxide, a powder of a metal which is difficult to volatize at 900°-1300° C., and a reducing agent, (b) heating the mixture to between 900° and 1300° C. in an inert atmosphere or under vacuum to produce a reaction mixture, and (c) treating the reaction mixture in a wet process to produce the alloy powder containing rare earth elements, the improvement wherein in step (a) at least one chloride selected from alkali metal chlorides and alkaline earth metal chlorides is added to said mixture so that the produced alloy powder will be in a finely divided form and the particles thereof will have a uniform composition and a minimum amount of residual reducing agent and oxygen.

2. A process as set forth in claim 1, wherein said chloride is selected from the group consisting of lithium chloride, sodium chloride, potassium chloride, magnesium chloride, and calcium chloride.

3. A process as set forth in claim 1, wherein the amount of said chloride is more than 1 wt % , based on the amount of the rare earth metal oxide.

4. A process as set forth in claim 3, wherein the amount of said chloride is 3 to 20 wt % , based on the amount of the rare earth metal oxide.

5. A process as set forth in claim 1, wherein the rare earth metal oxide is at least one oxide of an element selected from the group consisting of La, Ce, Pr, Nd, Sm, Eu, Gd, Tb, Dy, Ho, Er, Tm, Yb, Lu, Pm, Y and Sc.

6. A process as set forth in claim 1, wherein said metal which is difficult to volatize is a metal or an alloy containing at least one element selected from the group consisting of Co, Fe, Ni, Mn, Cu, Si, Al, Mo, Cr, B, Zr, Hf, Nb, Ta, Ti, Mg, V and W.

7. A process as set forth in claim 1, wherein the rare earth metal oxide is a powder having an average particle diameter of 1 to 50 μm (according to Fsss method).

8. A process as set forth in claim 1, wherein the hard volatile alloy is a powder having a particle size smaller than 100 mesh (according to Tyler method).

9. A process as set forth in claim 1, wherein the reducing agent is at least one member selected from the group consisting of alkali metals, alkaline earth metals, and hydrides thereof.

10. A process as set forth in claim 3, wherein said reducing agent is selected from the group consisting of lithium, sodium, potassium, magnesium, or calcium.

11. A process as set forth in claim 1, wherein the amount of the reducing agent is 1.1 to 2.0 times the stoichiometric amount necessary to reduce the rare earth metal oxide.

12. A process as set forth in claim 1, wherein the mixture is heated in step (b) to between 950° and 1100° C.

13. A process as set forth in claim 1, wherein the mixture is heated in step (b) in an atmosphere of argon or nitrogen.

* * * * *